US005446011A

United States Patent [19]

Hayakawa et al.

[11] Patent Number: 5,446,011

[45] Date of Patent: Aug. 29, 1995

[54] THERMOSENSITIVE RECORDING MATERIAL

[75] Inventors: Kunio Hayakawa, Gotenba; Masafumi Torii, Shizuoka, both of Japan

[73] Assignee: Ricoh Company, Ltd., Tokyo, Japan

[21] Appl. No.: 235,638

[22] Filed: Apr. 29, 1994

[30] Foreign Application Priority Data

| | | | |
|---|---|---|---|
| Apr. 30, 1993 | [JP] | Japan | 5-128100 |
| Sep. 2, 1993 | [JP] | Japan | 5-242069 |
| Nov. 8, 1993 | [JP] | Japan | 5-302414 |
| Apr. 8, 1994 | [JP] | Japan | 6-095553 |

[51] Int. Cl.[6] ..... B41M 5/30

[52] U.S. Cl. ..... 503/209; 427/150; 427/151; 503/208; 503/216; 503/223

[58] Field of Search ..... 427/150, 151; 503/208, 503/209, 216, 217, 225, 224, 220, 223

[56] References Cited

U.S. PATENT DOCUMENTS 4,257,954 3/1981 Schmidt et al. ..... 260/326.12 R 5,254,522 10/1993 Zink et al. ..... 503/217

*Primary Examiner*—B. Hamilton Hess

*Attorney, Agent, or Firm*—Oblon, Spivak, McClelland, Maier & Neustadt

[57] ABSTRACT

A thermosensitive recording material capable of being imagewise colored when heated, having a support, and a thermosensitive recording layer formed thereon which contains an N-substituted indole or an aromatic polyhydroxy compound, a carbonyl compound, and an acid material.

14 Claims, No Drawings

THERMOSENSITIVE RECORDING MATERIAL

BACKGROUND OF THE INVENTION

1. Field of the Invention

The present invention relates to a thermosensitive recording material capable of producing images with improved preservability and reliability.

2. Discussion of Background

There is conventionally known a thermosensitive recording material comprising a support and a thermosensitive recording layer formed thereon, comprising as the main components an electron-donor type colorless or light-colored dye precursor and an electron-acceptor type color developer. Colored images are obtained in the above-mentioned thermosensitive recording material in such a manner that the dye precursor is allowed to react with the color developer instantaneously by the application of heat to the thermosensitive recording layer using a thermal head, a thermal pen, laser beam or the like. Such a recording material has become the mainstream in this field, and the basic technique of this art is disclosed in Japanese Patent Publications 43-4160, 45-14039 and the like.

The thermosensitive recording material of this kind is widely utilized as a recording material for use with facsimile machines, label printers, and ticket vendors because of the following advantages over other conventional recording materials:

(1) images can be recorded by using a relatively simple device, (2) the maintenance of the device is easy, (3) images can be recorded without generating noise, and (4) the thermal coloring sensitivity is excellent and the coloring density of obtained images is high.

However, since this type of thermosensitive recording material utilizes the reversible reaction of the leuco dye, the thermosensitive recording material has the shortcomings that recorded images is fading away with time while allowed to stand for a long period of time, or become decolorized when the recorded images come into contact with chemicals, oils and water or exposed to light. Although various proposals are made to solve the aforementioned problems, all the problems are not completely solved.

As the thermosensitive recording material utilizing a nonreversible reaction, a thermosensitive recording material comprising an organic reducing agent or chelating agent as an electron-donor and a metallic salt of an organic acid as an electron-acceptor is proposed as disclosed in Japanese Patent Publications 32-8787 and 34-6485; a thermosensitive recording material comprising an imino compound and an isocyanate compound is proposed as in Japanese Laid-Open Patent Applications 58-38733 and 58-54085; and a thermosensitive recording material comprising an aromatic aldehyde compound, an organic condensation product containing $-NH_2$ group or $>NH$ group, and an electrophilic color developer is proposed as in Japanese Laid-Open Patent Application 4-221675. These nonreversible thermosensitive recording materials have the shortcomings that the background area is colored and the fogging readily takes place although the images recorded in these recording materials have good stability.

SUMMARY OF THE INVENTION

Accordingly, an object of the present invention is to provide a thermosensitive recording material free from the conventional drawbacks, capable of producing images with high preservability and reliability by a novel reaction.

The above-mentioned object of the present invention can be achieved by a thermosensitive recording material capable of being imagewise colored when heated comprising a support, and a thermosensitive recording layer formed thereon which comprises an N-substituted indole or an aromatic polyhydroxy compound, a carbonyl compound, and an acid material.

It is preferable that the aforementioned N-substituted indole be a compound of the following formula (1):

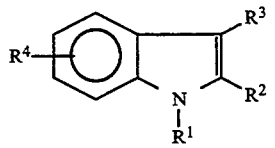

(1)

wherein $R^1$ is a halogen atom, an alkyl group having 1 to 5 carbon atoms which may have a substituent, an aryl group which may have a substituent, or an aralkyl group which may have a substituent; and $R^2$, $R^3$, $R^4$ and each is hydrogen, a halogen atom, an alkyl group having 1 to 5 carbon atoms which may have a substituent, an aryl group which may have a substituent, or an aralkyl group which may have a substituent.

Furthermore, the above-mentioned thermosensitive recording material may further comprise a quinone compound or a thermofusible material.

DESCRIPTION OF THE PREFERRED EMBODIMENTS

A thermosensitive recording material according to the present invention comprises (i) an N-substituted indole or an aromatic polyhydroxy compound, (ii) a carbonyl compound, and (iii) an acid material, so that the recording material can be imagewise colored when heated to produce images with high preservability and reliability. With the addition of (iv) a quinone compound or (v) a thermofusible material, the reliability of the obtained images can further be improved.

It is preferable that the N-substituted indole for use in the thermosensitive recording material of the present invention be a compound of the following formula (1):

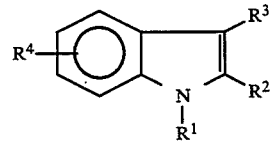

(1)

wherein $R^1$ is a halogen atom, an alkyl group having 1 to 5 carbon atoms which may have a substituent, an aryl group which may have a substituent, or an aralkyl group which may have a substituent; and $R^2$, $R^3$, and $R^4$ each is hydrogen, a halogen atom, an alkyl group having 1 to 5 carbon atoms which may have a substituent, an aryl group which may have a substituent, or an aralkyl group which may have a substituent.

Specific examples of $R^1$, $R^2$, $R^3$, and $R^4$ in formula (1) are as follows:

(1) An alkyl group having 1 to 5 carbon atoms, which may have at least one substituent selected from the group consisting of a halogen atom, carbonyl group, cyano group, alkoxycarbonyl group, an alkoxyl group, aryloxycarbonyl group, a substituted amino group and hydroxyl group.

Examples of the unsubstituted or substituted alkyl group include methyl group, ethyl group, propyl group, butyl group, isopropyl group, isobutyl group, tert-butyl group, chloromethyl group, hydroxyethyl group, methoxyethyl group, phenoxyethyl group, pyridylethyl group, and dichlorophenoxyethyl group.

(2) An aryl group which may have at least one substituent selected from the group consisting of an alkyl group, an alkoxyl group, an aryloxy group, a halogen atom, cyano group, nitro group, an acyl group, an arylsulfonyl group, hydroxyl group, and carboxyl group.

Examples of the unsubstituted or substituted aryl group include phenyl group, tolyl group, chlorophenyl group, methoxyphenyl group, acetylphenyl group, cyanophenyl group, hydroxyphenyl group, trifluoromethylphenyl group, methanesulfonylphenyl group, naphthyl group, and nitrophenyl group.

(3) An aralkyl group which may have at least one substituent selected from the group consisting of an alkyl group, an alkoxyl group, a halogen atom, cyano group, nitro group and hydroxyl group.

Examples of the unsubstituted or substituted aralkyl group include benzyl group, phenethyl group, chlorobenzyl group, nitrobenzyl group, hydroxybenzyl group, methylbenzyl group, cyanobenzyl group, and methoxybenzyl group.

Examples of the N-substituted indole compound of formula (1) are as follows: 1-methylindole, 1-ethylindole, 1-phenylindole, 1-benzylindole, 1,2-dimethylindole, 1-methyl-2-phenylindole, 1-methyl-2-ethylindole, 1,3-dimethylindole, 5-chloro-1,2-dimethylindole, 5-chloro-1-methyl-2-phenylindole, 5-hydroxy-1,2-dimethylindole, 5-methoxy-1,2-dimethylindole, 1-methyl-2-chloromethylindole, and 1-methyl-2-tolylindole.

Examples of the aromatic polyhydroxy compound for use in the present invention are as follows: resorcinol, hydroquinone, pyrogallol, phloroglucinol, hydroxyhydroquinone, pyrogallol-4-carboxylic acid, phloroglucinolcarboxylic acid, and dihydroxynaphthalene.

As the carbonyl compound for use in the thermosensitive recording material of the present invention, an aromatic aldehyde compound, an aromatic ketone compound and a heterocyclic aldehyde compound can be employed.

It is preferable that the aromatic aldehyde compound or aromatic ketone compound be a compound of formula (2):

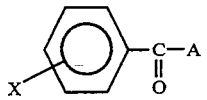

(2)

wherein A is hydrogen, an alkyl group having 1 to 5 carbon atoms which may have a substituent, an aralkyl group which may have a substituent, or an aryl group which may have a substituent; and X is hydrogen, an alkyl group having 1 to 5 carbon atoms which may have a substituent, an alkoxyl group having 1 to 5 carbon atoms which may have a substituent, a halogen atom, or amino group which may have a substituent.

Specific examples of the aromatic aldehyde compound or aromatic ketone compound of formula (2) are as follows:

4-dimethylaminobenzaldehyde,
4-diethylaminobenzaldehyde,
4-dibenzylaminobenzaldehyde,
4-diphenylaminobenzaldehyde,
4-N-methyl-N-p-dimethylaminophenylbenzaldehyde,
4-N-ethyl-N-p-diethylaminophenylbenzaldehyde,
4-N-methyl-N-p-methoxyphenylbenzaldehyde,
4-bis-p-tolylaminobenzaldehyde,
4-dimethylamino-2-methylbenzaldehyde,
4-dimethylamino-2-methoxybenzaldehyde,
4-dimethylaminoacetophenone,
4-diethylaminoacetophenone,
4-methoxyacetophenone,
4-dimethylaminobenzophenone,
4-methoxybenzophenone,
4,4'-bisdimethylaminobenzophenone,
4,4'-bisdiethylaminobenzophenone,
4-dimethylamino-4'-methoxybenzophenone,
4-dimethylamino-4'-methylbenzophenone, and
4-dimethylamino-4'-chlorobenzophenone.

As the heterocyclic aldehyde compound, substituted or unsubstituted indole, isoindole, indazole, carbazole, quinoline, pyridine, isoquinoline, cinnoline, quinazoline, quinoxaline, phthalazine, purine, pyrrole, imidazole, pyrazole, thiophene, benzothiophene, furan, and benzofuran can be employed.

Specific examples of the heterocyclic aldehyde compound are as follows: indole-3-carboxyaldehyde, 2-methylindole-3-carboxyaldehyde, 1,2-dimethylindole-3-carboxyaldehyde, 2-phenylindole-3-carboxyaldehyde, 1-methyl-2-phenylindole-3-carboxyaldehyde, 1-methylindole-3-carboxyaldehyde, carbazole-3-carboxyaldehyde, N-methylcarbazole-3-carboxyaldehyde, N-ethylcarbazole-3-carboxyaldehyde, N-phenylcarbazole-3-carboxyaldehyde, 2-chloro- 6-methoxy-3-quinolinecarboaldehyde, 2-chloro-6,7-dimethoxy-3-quinolinecarboaldehyde, 2-chloro-5,6,7-trimethoxy-3-quinolinecarboaldehyde, pyridine-3-carboaldehyde, pyrrole-2-carboaldehyde, 4-methylfuran-2-carboaldehyde, thiophene-2-carboaldehyde, and 3-methylbenzofuran-2-carboaldehyde.

As the acid material for use in the thermosensitive recording material of the present invention, Bronsted acids and Lewis acids such as carboxylic acid, sulfonic acid, sulfinic acid, and phosphoric acid can be employed.

Specific examples of the Bronsted acid and Lewis acid are as follows: dinitrobenzoic acid, dichlorobenzoic acid, dihydroxybenzoic acid, salicylic acid, acetylsalicylic acid, maleic acid, benzoic acid, cyanobenzoic acid, nitrobenzoic acid, trifluoromethylbenzoic acid, methoxybenzoic acid, chlorobenzoic acid, aminobenzoic acid, hydroxybenzoic acid, naphthoic acid, 3,4-dihydroxyphenyl-4'-tolylsulfone, benzenesulfonic acid, toluenesulfonic acid, benzenesulfinic acid, toluenesulfinic acid, mesitylenesulfonic acid, diphenylphosphonic acid, phenylphosphonic acid, phenylphosphonous acid, phenylphosphoric acid, phenylphosphinic acid, zinc salicylate, zinc chloride, zinc bromide, aluminum chloride, nitrophthalic acid, nitroisophthalic acid, gallic acid, trifluoromethylphthalic acid, methanesulfonic aicd, ethanesulfonic acid, hydroxybenzenesulfonic acid, nitrobenzenesulfonic acid, chlorobenzenesulfonic acid, methanesulfinic acid, ethanesulfinic acid, hydroxybenzenesulfinic acid, nitrobenzenesulfinic acid, and chlorobenzenesulfinic acid.

It is preferable that the acid material for use in the present invention comprise at least one component selected from the group consisting of an organic carboxylic acid, an organic sulfonic acid and a metallic chloride.

The acid material for use in the thermosensitive recording layer of the recording material according to the present invention may be a compound which can be thermally decomposed to become acidic when the thermal energy is applied thereto, such as a sulfonic acid ester compound or an aromatic acetyloxy compound.

In particular, a sulfonic acid ester compound with a thermal decomposition temperature of 60° C. or more is preferable. Examples of an organic sulfonic acid for such a sulfonic acid ester compound are as follows: benzenesulfonic acid, p-toluenesulfonic acid, 4-bromobenzenesulfonic acid, 4-methoxybenzenesulfonic acid, 4-benzyloxybenzenesulfonic acid, β-naphthalenesulfonic acid, 1,3-benzenedisulfonic acid, methanesulfonic acid, ethanesulfonic acid, 2-nitrobenzenesulfonic acid, 3-nitrobenzenesulfonic acid, and 4-nitrobenzenesulfonic acid. Examples of an alcohol for the sulfonic acid ester compound are as follows: methanol, ethanol, propanol, isopropanol, 2-phenylethanol, 1-phenylpropanol, butanol, isobutanol, sec-butyl alcohol, tert-butyl alcohol, amyl alcohol, cyclohexanol, 2-methylhexanol, 4-methylhexanol, 4-tert-butylcyclohexanol, 2-cyclohexanol, 4-cyclohexanol, 2,6-dimethylcyclohexanol, benzhydrol, 1-phenylethanol, 2,3-dihydroindene-2-ol, 2-phenyl-1,3-dioxane-5-ol, ethylene glycol, diethylene glycol, propylene glycol, 2,2-dimethyl-1,3-propanediol, 1,4-butanediol, 2,3-butanediol, 2,5-hexanediol, 1,2-cyclohexanediol, 1,3-cyclohexanediol, 1,4-cyclohexanediol, and 2,2-bis(4-cyclohexyl)propane.

Specific examples of the above-mentioned sulfonic acid ester compounds are as follows:
cyclohexyl-p-toluenesulfonate,
cyclohexyl benzenesulfonate,
cyclohexyl-o-nitorbenzenesulfonate,
cyclohexyl-m-nitrobenzenesulfonate,
cyclohexyl-p-nitrobenzenesulfonate,
cyclohexyl-β-naphthalenesulfonate,
cyclohexyl methanesulfonate,
2-methylcyclohexyl-p-toluenesulfonate,
2-methylcyclohexyl benzenesulfonate,
2-methylcyclohexyl-o-nitrobenzenesulfonate,
2-methylcyclohexyl-m-nitrobenzenesulfonate,
2-methylcyclohexyl-p-nitrobenzenesulfonate,
2-methylcyclohexyl-β-naphthalenesulfonate,
2-methylcyclohexyl methanesulfonate,
2-cyclohexylcyclohexyl-p-toluenesulfonate,
2-cyclohexylcyclohexyl benzenesulfonate,
2-cyclohexylcyclohexyl-o-nitrobenzenesulfonate,
2-cyclohexylcyclohexyl-m-nitrobenzenesulfonate,
2-cyclohexylcyclohexyl-p-nitrobenzenesulfonate,
2-cyclohexylcyclohexyl-β-naphthalenesulfonate,
2-cyclohexylcyclohexyl methanesulfonate,
4-tert-butylcyclohexyl-p-toluenesulfonate,
4-tert-butylcyclohexyl benzenesulfonate,
4-tert-butylcyclohexyl-o-nitrobenzenesulfonate,
4-tert-butylcyclohexyl-m-nitrobenzenesulfonate,
4-tert-butylcyclohexyl-p-nitrobenzenesulfonate,
4-tert-butylcyclohexyl-β-naphthalenesulfonate,
4-tert-butylcyclohexyl methanesulfonate,
1,3-cyclohexylenebis(p-toluenesulfonate),
1,3-cyclohexylenebis(benzenesulfonate),
1,3-cyclohexylenebis(o-nitrobenzenesulfonate),
1,3-cyclohexylenebis(m-nitrobenzenesulfonate),
1,3-cyclohexylenebis(p-nitrobenzenesulfonate),
1,3-cyclohexylenebis(methanesulfonate),
1,3-cyclohexylenebis(β-naphthalenesulfonate),
1,4-cyclohexylenebis(p-toluenesulfonate),
1,4-cyclohexylenebis(benzenesulfonate),
1,4-cyclohexylenebis(o-nitrobenzenesulfonate),
1,4-cyclohexylenebis(m-nitrobenzenesulfonate),
1,4-cyclohexylenebis(p-nitrobenzenesulfonate),
1,4-cyclohexylenebis(methanesulfonate),
1,4-cyclohexylenebis(β-naphthalenesulfonate),
2,3-butylenebis(p-toluenesulfonate),
2,3-butylenebis(benzenesulfonate),
2,3-butylenebis(o-nitrobenzenesulfonate),
2,3-butylenebis(m-nitrobenzenesulfonate),
2,3-butylenebis(p-nitrobenzenesulfonate),
2,3-butylenebis(methanesulfonate),
2,3-butylenebis(β-naphthalenesulfonate),
diphenylmethane p-toluenesulfonate,
diphenylmethane benzenesulfonate,
diphenylmethane o-nitrobenzenesulfonate,
diphenylmethane m-nitrobenzenesulfonate,
diphenylmethane p-nitrobenzenesulfonate,
diphenylmethane methanesulfonate,
diphenylmethane β-naphthalenesulfonate,
1-phenylethyl p-toluenesulfonate,
1-phenylethyl benzenesulfonate,
1-phenylethyl o-nitrobenzenesulfonate,
1-phenylethyl m-nitrobenzenesulfonate,
1-phenylethyl p-nitrobenzenesulfonate,
1-phenylethyl methanesulfonate,
1-phenylethyl β-naphthalenesulfonate,
4-cyclohexylcyclohexyl benzenesulfonate,
2-phenyl-1,3-dioxane-5-yl-benzenesulfonate, and
2,3-dihydroindene-2-yl-benzenesulfonate.

The thermosensitive recording layer of the recording material according to the present invention may further comprise a quinone compound to further increase the reliability of the obtained images.

The quinone compound for use in the present invention is represented by the following formula (3) or (4):

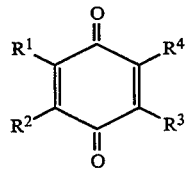

(3)

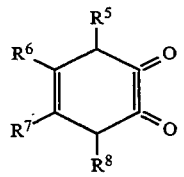

(4)

wherein $R^1$ to $R^8$ each is a halogen atom, cyano group, nitro group, carboxyl group, alkoxycarbonyl group, aryloxycarbonyl group, aralkyloxycarbonyl group, alkylsulfonyl group, or an arylsulfonyl group.

Specific examples of the quinone compound of formula (3) or (4) are as follows: benzoquinone, naphthoquinone, anthraquinone, chloranil, 2-methylnaphthoquinone, dichloronaphthoquinone, chloranilic acid, dibenzoylbenzoquinone, dicyanodichlorobenzoquinone, tetracyanoquinone, dibromodicyanoquinone, tetrabromoquinone, tetramethoxycarbonyl benzoquinone, tetraphenoxycarbonyl benzoquinone, dibenzyloxy dichlorobenzoquinone, and diethoxycarbonyl diphenylsulfonylbenzoquinone.

Furthermore, the thermosensitive recording layer may further comprise a thermofusible material to improve the thermosensitivity of the recording material. A variety of thermofusible materials and phenolic compounds serving as the color developers for use in the conventional leuco-compound-containing thermosensitive recording materials are preferred as the thermofusible materials in the present invention.

In particular, a phenolic compound is preferable when the acid material capable of being thermally decomposed to reveal acidic nature by the application of heat thereto is contained in the thermosensitive recording material of the present invention. This is because the thermal decomposition of the acid material is promoted under an acid atmosphere of the phenolic compound. In this case, an organic carboxylic acid can be utilized besides the phenolic compound.

Specific examples of the thermofusible material for use in the thermosensitive recording material of the present invention are as follows: 4,4'-isopropylidenebisphenol, 4,4'-diphenolsulfone, 4-isopropoxy-4'-hydroxydiphenylsulfone, 4-benzyloxy-4'-hydroxydiphenylsulfone, bis(4-hydroxy-3-allylphenyl)-sulfone, benzyl 4-hydroxybenzoate, methyl bis(4-hydroxyphenyl)acetate, benzyl bis(4-hydroxyphenyl)-acetate, bis(4-hydroxy-3-methylphenyl)sulfide, 1,7-bis(4-hydroxyphenylthio)-3,5-dioxaheptane, 3,4-dihydroxy-4'-methylsulfone, 2,4'-diphenolsulfone, 1,3-bis(4-hydroxycumyl)benzene, benzyl protocatechuate, 1,3-bis(4-hydroxyphenylthio)propane, 1,3-bis(4-hydroxyphenylthio)-dihydroxypropane, stearamide, p-benzylbiphenyl, triphenylmethane, benzyl p-benzyloxybenzoate, phenyl 1-hydroxy-2-naphthoate, diphenylcarbonate, dibenzyl terephthalate, dibenzyl oxalate, (p-tolylmethyl)oxalate, 1,4-bis(2-vinyloxyethoxy)benzene, 1,4-bis(phenoxy)ethane, and phenyl p-toluenesulfonate.

To fabricate the thermosensitive recording material according to the present invention, the previously mentioned N-substituted indole or aromatic polyhydroxy compound, carbonyl compound, and acid material are dispersed together with a binder agent in water to prepare a coating liquid for a thermosensitive recording layer. The thus prepared thermosensitive recording layer coating liquid may be coated on a support, whereby a thermosensitive recording material according to the present invention can be fabricated.

Examples of the binder agent used in preparing the thermosensitive recording layer coating liquid are as follows: starches, hydroxyethyl cellulose, carboxymethyl cellulose, gelatin, casein, gum arabic, polyvinyl alcohol, carboxyl-group-modified polyvinyl alcohol, salts of diisobutylene—maleic anhydride copolymer, salts of styrene—maleic anhydride copolymer, salts of ethylene—acrylic copolymer, salts of styrene—acrylic copolymer, styrene—butadiene copolymer emulsion, urea resin, melamine resin, and amide resin.

Furthermore, various kinds of assistants may be added to the coating liquid for the thermosensitive recording layer when necessary. For instance, a dispersant such as dioctyl sodium sulfosuccinate, sodium dodecylbenzenesulfonate, lauryl alcohol sulfate or a fatty acid metallic salt; a benzophenone-based ultraviolet light absorber; an anti-foaming agent; a fluorescent dye; and a color dye may appropriately be contained in the thermosensitive recording layer coating liquid. In addition, waxes such as zinc stearate, calcium stearate, polyethylene wax, carnauba wax and ester wax; and inorganic pigments such as kaolin, clay, talc, calcium carbonate, calcined kaolin, titanium oxide, and diatomite may be contained in the thermosensitive recording layer coating liquid.

In the present invention, an intermediate layer comprising spherical hollow particles which comprise a thermoplastic resin as a shell may be interposed between the support and the thermosensitive recording layer to remarkably improve the thermosensitivity. Such an intermediate layer serves as a heat-insulating layer to efficiently utilize the thermal energy applied to the recording material by heat-application means such as a thermal head. Each of the hollow particles for use in the intermediate layer comprises a shell which comprises a thermoplastic resin and contains air or other gasses therein. The average particle diameter of the hollow particles are preferably in the range from 2 to 10 μm. As the thermoplastic resin for use in the shell of each hollow particle, a copolymer mainly comprising vinylidene chloride and acrylonitrile is preferably employed.

Other features of this invention will become apparent in the course of the following description of exemplary embodiments, which are given for illustration of the invention and are not intended to be limiting thereof.

EXAMPLE 1

Formation of Thermosensitive Recording Layer

A mixture of the following components was separately dispersed in a magnetic ball mill, so that a Liquid A, a Liquid B, a Liquid C, a Liquid D and a Liquid E were prepared:

| | Parts by Weight |
|---|---|
| [Liquid A] | |
| Compound (i): 1-methyl-2-phenylindole | 10 |
| 10% aqueous solution of polyvinyl alcohol | 10 |
| Water | 30 |
| [Liquid B] | |
| Compound (ii): p-diphenylaminobenzaldehyde | 10 |
| 10% aqueous solution of polyvinyl alcohol | 10 |
| Water | 30 |
| [Liquid C] | |
| Compound (iii): 2,4-dinitrobenzoic acid | 10 |
| 10% aqueous solution of polyvinyl alcohol | 10 |
| Water | 30 |
| (Liquid D) | |
| Calcium carbonate | 10 |
| 10% aqueous solution of polyvinyl alcohol | 10 |
| Water | 30 |
| [Liquid E] | |
| Zinc stearate | 10 |
| 10% aqueous solution of polyvinyl alcohol | 10 |
| Water | 30 |

The Liquid A, Liquid B, Liquid C, Liquid D and Liquid E were mixed at a ratio by weight of (1:1:4:3:1)

to prepare a coating liquid for a thermosensitive recording layer. The thus prepared thermosensitive recording layer coating liquid was coated on a sheet of commercially available high quality paper with a basis weight of 52 g/m$^2$ serving as a support in a deposition amount of 0.5 g/m$^2$ on a dry basis, and then dried, so that a thermosensitive recording layer was provided on the support.

The thermosensitive recording layer was subjected to calendering so as to have a surface smoothness of 500 to 3000 sec in terms of Bekk's smoothness.

Thus, a thermosensitive recording material No. 1 according to the present invention was fabricated.

EXAMPLES 2 TO 18

The procedure for preparation of the thermosensitive recording material No. 1 according to the present invention in Example 1 was repeated except that the compounds (i), (ii) and (iii) respectively used in the Liquids A, B and C in Example 1 were changed as shown in Table 1, so that thermosensitive recording materials No. 2 to No. 18 according to the present invention were fabricated.

EXAMPLE 19

Formation of Thermosensitive Recording Layer

A mixture of the following components was separately dispersed in a magnetic ball mill, so that a Liquid A, a Liquid B, a Liquid C, a Liquid D, a Liquid E and a Liquid F were prepared:

| | Parts by Weight |
|---|---|
| [Liquid A] | |
| Compound (i): 1-methyl-2-phenylindole | 10 |
| 10% aqueous solution of polyvinyl alcohol | 10 |
| Water | 30 |
| [Liquid B] | |
| Compound (ii): p-diphenylaminobenzaldehyde | 10 |
| 10% aqueous solution of polyvinyl alcohol | 10 |
| Water | 30 |
| [Liquid C] | |
| Compound (iii): 2,4-dinitrobenzoic acid | 10 |
| 10% aqueous solution of polyvinyl alcohol | 10 |
| Water | 30 |
| [Liquid D] | |
| Calcium carbonate | 10 |
| 10% aqueous solution of polyvinyl alcohol | 10 |
| Water | 30 |
| [Liquid E] | |
| Zinc stearate | 10 |
| 10% aqueous solution of polyvinyl alcohol | 10 |
| Water | 30 |
| [Liquid F] | |
| Compound (iv) or (v): Chloranil | 10 |
| 10% aqueous solution of polyvinyl alcohol | 10 |
| Water | 30 |

The Liquid A, Liquid B, Liquid C, Liquid D, Liquid E and Liquid F were mixed at a ratio by weight of (1:1:4:3:1:1) to prepare a coating liquid for a thermosensitive recording layer. The thus prepared thermosensitive recording layer coating liquid was coated on a sheet of commercially available high quality paper with a basis weight of 52 g/m$^2$ serving as a support in a deposition amount of 0.5 g/m$^2$ on a dry basis, and then dried, so that a thermosensitive recording layer was provided on the support.

The thermosensitive recording layer was subjected to calendering so as to have a surface smoothness of 500 to 3000 sec in terms of Bekk's smoothness.

Thus, a thermosensitive recording material No. 19 according to the present invention was fabricated.

EXAMPLES 20 TO 22

The procedure for preparation of the thermosensitive recording material No. 19 according to the present invention in Example 19 was repeated except that the compound (iii), and the compound (iv) or (v) respectively used in the Liquids C and F in Example 19 were changed as shown in Table 1, so that thermosensitive recording materials No. 20 to No. 22 according to the present invention were fabricated.

EXAMPLE 23

Formation of Thermosensitive Recording Layer

A mixture of the following components was separately dispersed in a magnetic ball mill, so that a Liquid A, a Liquid B', a Liquid C', a Liquid D, a Liquid E and a Liquid F' were prepared:

| | Parts by Weight |
|---|---|
| [Liquid A] | |
| Compound (i): 1-methyl-2-phenylindole | 10 |
| 10% aqueous solution of polyvinyl alcohol | 10 |
| Water | 30 |
| [Liquid B'] | |
| Compound (ii): p-dimethylaminobenzaldehyde | 10 |
| 10% aqueous solution of polyvinyl alcohol | 10 |
| Water | 30 |
| [Liquid C'] | |
| Compound (iii): 2-methylcyclohexyl-m-nitrobenzenesulfonate | 10 |
| 10% aqueous solution of polyvinyl alcohol | 10 |
| Water | 30 |
| [Liquid D] | |
| Calcium carbonate | 10 |
| 10% aqueous solution of polyvinyl alcohol | 10 |
| Water | 30 |
| [Liquid E] | |
| Zinc stearate | 10 |
| 10% aqueous solution of polyvinyl alcohol | 10 |
| Water | 30 |
| [Liquid F'] | |
| Compound (iv) or (v): 4-hydroxy-4'-isopropoxy-diphenylsulfone | 10 |
| 10% aqueous solution of polyvinyl alcohol | 10 |
| Water | 30 |

The Liquid A, Liquid B', Liquid C', Liquid D, Liquid E and Liquid F' were mixed at a ratio by weight of (1:1:4:3:1:2) to prepare a coating liquid for a thermosensitive recording layer. The thus prepared thermosensitive recording layer coating liquid was coated on a sheet of commercially available high quality paper with a basis weight of 52 g/m$^2$ serving as a support in a deposition amount of 0.5 g/m$^2$ on a dry basis, and then dried, so that a thermosensitive recording layer was provided on the support.

The thermosensitive recording layer was subjected to calendering so as to have a surface smoothness of 500 to 3000 sec in terms of Bekk's smoothness.

Thus, a thermosensitive recording material No. 23 according to the present invention was fabricated.

EXAMPLES 24 TO 36

The procedure for preparation of the thermosensitive recording material No. 23 according to the present invention in Example 23 was repeated except that the compound (ii), the compound (iii), and the compound (iv) or (v) respectively used in the Liquids B', C' and F' in Example 23 were changed as shown in Table 1, so that thermosensitive recording materials No. 24 to No. 36 according to the present invention were fabricated.

TABLE 1

| Example No. | Compound (i) | Compound (ii) | Compound (iii) | Compound (iv) or (v) |
|---|---|---|---|---|
| Ex. 1 | 1-methyl-2-phenylindole | p-diphenylamino-benzaldehyde | 2,4-dinitrobenzoic acid | — |
| Ex. 2 | 1-methyl-2-phenylindole | p-dimethylamino-benzaldehyde | salicylic acid | — |
| Ex. 3 | 1-methyl-2-phenylindole | p-diethylamino-benzaldehyde | salicylic acid | — |
| Ex. 4 | 1-methyl-2-phenylindole | p-diphenylamino-benzaldehyde | 2,6-dihydroxybenzoic acid | — |
| Ex. 5 | 1-methyl-2-phenylindole | p-diphenylamino-benzaldehyde | 2,6-dichlorobenzoic acid | — |
| Ex. 6 | 1-methyl-2-phenylindole | p-dimethylamino-benzaldehyde | zinc chloride | — |
| Ex. 7 | 1-methyl-2-phenylindole | p-dimethylamino-benzaldehyde | 3,4-dihydroxyphenyl-4'-trisulfone | — |
| Ex. 8 | 1-methyl-2-phenylindole | p-dimethylamino-benzaldehyde | diphenylsulfonic acid | — |
| Ex. 9 | 1-methyl-2-phenylindole | p-dimethylamino-benzaldehyde | zinc p-cyanobenzoate | — |
| Ex. 10 | 1-methylindole | p-diphenylamino-benzaldehyde | 2,4-dinitrobenzoic acid | — |
| Ex. 11 | 1-ethylindole | p-diphenylamino-benzaldehyde | 2,4-dinitrobenzoic acid | |
| Ex. 12 | 2,4-dihydroxy-benzene | p-diphenylamino-benzaldehyde | 2,4-dinitrobenzoic acid | — |
| Ex. 13 | 1,2,3-trihydroxy-benzene | p-diphenylamino-benzaldehyde | 2,4-dinitrobenzoic acid | — |
| Ex. 14 | 1,3,5-trihydroxy-benzene | p-diphenylamino-benzaldehyde | 2,4-dinitrobenzoic acid | — |
| Ex. 15 | 1-methyl-2-phenylindole | N-ethylcarbazole-3-carboxylaldehyde | 2,4-dinitrobenzoic acid | — |
| Ex. 16 | 1-methyl-2-phenylindole | 1-methyl-2-phenyl-indole-3-carboxy-aldehyde | 2,4-dinitrobenzoic acid | — |
| Ex. 17 | 1-methyl-2-phenylindole | 2-phenylindole-3-carboxyaldehyde | 2,4-dinitrobenzoic acid | — |
| Ex. 18 | 1-methyl-2-phenylindole | N-phenylcarbazole-3-carboxyaldehyde | 2,4-dinitrobenzoic acid | — |
| Ex. 19 | 1-methyl-2-phenylindole | p-diphenylamino-benzaldehyde | 2,4-dinitrobenzoic acid | chloranil |
| Ex. 20 | 1-methyl-2-phenylindole | p-diphenylamino-benzaldehyde | 2,4-dinitrobenzoic acid | 2-methyl-1,4-naphthoquinone |
| Ex. 21 | 1-methyl-2-phenylindole | p-diphenylamino-benzaldehyde | 2,6-dihydroxybenzoic acid | chloranil |
| Ex. 22 | 1-methyl-2-phenylindole | p-diphenylamino-benzaldehyde | 2,6-dihydroxybenzoic acid | 2-methyl-1,4-naphthoquinone |
| Ex. 23 | 1-methyl-2-phenylindole | p-dimethylamino-benzaldehyde | 2-methylcyclohexyl-m-nitrobenzenesulfonate | 4-hydroxy-4'-isopropoxy-diphenylsulfone |
| Ex. 24 | 1-methyl-2-phenylindole | p-dimethylamino-benzaldehyde | 2-cyclohexylcyclo-hexyl-m-nitrobenzene-sulfonate | 4-hydroxy-4'-isopropoxy-diphenylsulfone |
| Ex. 25 | 1-methyl-2-phenylindole | p-dimethylamino-benzaldehyde | 4-tert-butylcyclohexyl-m-nitrobenzenesulfonate | 4-hydroxy-4'-isopropoxy-diphenylsulfone |
| Ex. 26 | 1-methyl-2-phenylindole | p-dimethylamino-benzaldehyde | 1,3-cyclohexylidenebis-m-nitrobenzenesulfonate | 4-hydroxy-4'-isopropoxy-diphenylsulfone |
| Ex. 27 | 1-methyl-2-phenylindole | p-dimethylamino-benzaldehyde | 1,4-cyclohexylidenebis-(m-nitrobenzenesulfonate) | 4-hydroxy-4'-isopropoxy-diphenylsulfone |
| Ex. 28 | 1-methyl-2-phenylindole | p-diphenylamino-benzaldehyde | 2-methylcyclohexyl-m-nitrobenzenesulfonate | 4-hydroxy-4'-isopropoxy-diphenylsulfone |
| Ex. 29 | 1-methyl-2-phenylindole | p-diphenylamino-benzaldehyde | 2-cyclohexylcyclohexyl-m-nitrobenzenesulfonate | 4-hydroxy-4'-isopropoxy-diphenylsulfone |
| Ex. 30 | 1-methyl-2- | p-diphenylamino- | 4-tert-butylcyclohexyl-m- | 4-hydroxy-4'- |

TABLE 1-continued

| Example No. | Compound (i) | Compound (ii) | Compound (iii) | Compound (iv) or (v) |
|---|---|---|---|---|
| | phenylindole | benzaldehyde | nitrobenzenesulfonate | isopropoxy-diphenylsulfone |
| Ex. 31 | 1-methyl-2-phenylindole | p-diphenylamino-benzaldehyde | 1,3-cyclohexylidenebis-(nitrobenzenesulfonate) | 4-hydroxy-4'-isopropoxy-diphenylsulfone |
| Ex. 32 | 1-methyl-2-phenylindole | p-diphenylamino-benzaldehyde | 1,4-cyclohexylidenebis-(m-nitrobenzenesulfonate) | 4-hydroxy-4'-isopropoxy-diphenylsulfone |
| Ex. 33 | 1-methyl-2-phenylindole | p-diphenylamino-benzaldehyde | 2,4-dinitrobenzoic acid | 4-hydroxy-4'-isopropoxy-diphenylsulfone |
| Ex. 34 | 1-methyl-2-phenylindole | p-diphenylamino-benzaldehyde | 2,4-dinitrobenzoic acid | bisphenol A |
| Ex. 35 | 1-methyl-2-phenylindole | p-diphenylamino-benzaldehyde | 2,4-dinitrobenzoic acid | phenyl p-toluenesulfonate |
| Ex. 36 | 1-methyl-2-phenylindole | p-diphenylamino-benzaldehyde | 2,4-dinitrobenzoic acid | 1,4-bis(4'-hydroxyphenyl-thio)-2-oxabutane |

COMPARATIVE EXAMPLE 1

Formation of Thermosensitive Recording Layer

A mixture of the following components was separately dispersed in a magnetic ball mill, so that a Liquid G, a Liquid H, a Liquid D and a Liquid E were prepared:

| | Parts by Weight |
|---|---|
| [Liquid G] | |
| 3-dibutylamino-6-methyl-7-anilinofluoran | 10 |
| 10% aqueous solution of polyvinyl alcohol | 10 |
| Water | 30 |
| [Liquid H] | |
| Bisphenol A | 10 |
| 10% aqueous solution of polyvinyl alcohol | 10 |
| Water | 30 |
| [Liquid D] | |
| Calcium carbonate | 10 |
| 10% aqueous solution of polyvinyl alcohol | 10 |
| Water | 30 |
| [Liquid E] | |
| Zinc stearate | 10 |
| 10% aqueous solution of polyvinyl alcohol | 10 |
| Water | 30 |

The Liquid G, Liquid H, Liquid D and Liquid E were mixed at a ratio by weight of (1:3:4:1) to prepare a coating liquid for a thermosensitive recording layer. The thus prepared thermosensitive recording layer coating liquid was coated on a sheet of commercially available high quality paper with a basis weight of 52 $g/m^2$ serving as a support in a deposition amount of 0.5 $g/m^2$ on a dry basis, and then dried, so that a thermosensitive recording layer was provided on the support.

The thermosensitive recording layer was subjected to calendering so as to have a surface smoothness of 500 to 3000 sec in terms of Bekk's smoothness.

Thus, a comparative thermosensitive recording material No. 1 was fabricated.

COMPARATIVE EXAMPLE 2

The procedure for preparation of the comparative thermosensitive recording material No. 1 in Comparative Example 1 was repeated except that bisphenol A used in the Liquid H in Comparative Example 1 was replaced by bis(3-allyl-4-hydroxyphenyl)sulfone, so that a comparative thermosensitive recording material No. 2 was fabricated.

COMPARATIVE EXAMPLE 3

The procedure for preparation of the comparative thermosensitive recording material No. 1 in Comparative Example 1 was repeated except that bisphenol A used in the Liquid H in Comparative Example 1 was replaced by 4-hydroxy-4'-isopropoxydiphenylsulfone, so that a comparative thermosensitive recording material No. 3 was fabricated.

Each of the thermosensitive recording materials No. 1 to No. 36 according to the present invention and comparative thermosensitive recording materials No. 1 to No. 3 was subjected to the tests to evaluate the following items:

(1) Coloring Thermosensitivity

Thermal printing was carried out on each of the thermosensitive recording materials using a commercially available heat gradient tester made by Toyo Seiki Seisaku-sho, Ltd., in such a manner that the recording material was heated to 150° C. with the application of a pressure of 2 $kg/cm^2$ thereto for one second. The image density of the colored portion and the density of the background were measured by a Mcbeth densitometer RD-914.

(2) Reliability of the Obtained Images

(a) Oil Resistance

A cottonseed oil was applied to an image sample prepared by the above-mentioned thermal printing operation. The image sample was allowed to stand at 40° C. for 16 hours, and then the image density of the colored portion and the density of the background were measured by a Mcbeth densitometer RD-914.

(b) Plasticizer Resistance

Dioctyl adipate (DOA), a plasticizer, was applied to an image sample prepared by the above-mentioned thermal printing operation. The image sample was allowed to stand at 40° C. for 16 hours, and then the image density of the colored portion and the density of the background were measured by a Mcbeth densitometer RD-914.

(c) Water Resistance

Each image sample was immersed in water at room temperature for 16 hours, and then the image density of the colored portion and the density of the background were measured by a Mcbeth densitometer RD-914.

The results of the above-mentioned tests are shown in Table 2.

TABLE 2

| Example No. | Coloring Thermosensitivity | | Water-resistance | | Resistance to Cottonseed Oil | | Resistance to DOA | |
|---|---|---|---|---|---|---|---|---|
| | Image density | Density of background | Image density | Density of background | Image density | Density of background | Image density | Density of background |
| Ex. 1 | 0.80 | 0.11 | 0.51 | 0.11 | 0.72 | 0.26 | 0.65 | 0.15 |
| Ex. 2 | 0.85 | 0.19 | 0.82 | 0.11 | 0.92 | 0.19 | 0.84 | 0.19 |
| Ex. 3 | 0.91 | 0.16 | 0.86 | 0.11 | 0.95 | 0.19 | 0.88 | 0.17 |
| Ex. 4 | 1.20 | 0.20 | 1.10 | 0.17 | 1.01 | 0.35 | 0.90 | 0.36 |
| Ex. 5 | 1.00 | 0.16 | 0.85 | 0.14 | 0.98 | 0.25 | 1.01 | 0.26 |
| Ex. 6 | 0.86 | 0.22 | 0.73 | 0.16 | 0.81 | 0.30 | 0.75 | 0.28 |
| Ex. 7 | 0.66 | 0.18 | 0.60 | 0.14 | 0.65 | 0.19 | 0.59 | 0.16 |
| Ex. 8 | 0.86 | 0.12 | 0.77 | 0.11 | 0.88 | 0.20 | 0.80 | 0.19 |
| Ex. 9 | 0.65 | 0.15 | 0.56 | 0.12 | 0.61 | 0.15 | 0.59 | 0.16 |
| Ex. 10 | 0.81 | 0.14 | 0.78 | 0.11 | 0.85 | 0.20 | 0.80 | 0.25 |
| Ex. 11 | 0.80 | 0.12 | 0.80 | 0.11 | 0.78 | 0.16 | 0.75 | 0.16 |
| Ex. 12 | 0.92 | 0.18 | 0.82 | 0.10 | 0.88 | 0.16 | 0.89 | 0.15 |
| Ex. 13 | 0.95 | 0.15 | 0.89 | 0.10 | 0.90 | 0.16 | 0.91 | 0.15 |
| Ex. 14 | 0.85 | 0.15 | 0.80 | 0.12 | 0.80 | 0.16 | 0.80 | 0.16 |
| Ex. 15 | 0.90 | 0.11 | 0.67 | 0.13 | 0.85 | 0.24 | 0.68 | 0.16 |
| Ex. 16 | 0.86 | 0.15 | 0.70 | 0.13 | 0.81 | 0.15 | 0.60 | 0.19 |
| Ex. 17 | 0.80 | 0.12 | 0.65 | 0.15 | 0.72 | 0.21 | 0.79 | 0.13 |
| Ex. 18 | 0.90 | 0.20 | 0.65 | 0.15 | 0.83 | 0.21 | 0.88 | 0.22 |
| Ex. 19 | 1.00 | 0.11 | 0.97 | 0.13 | 1.12 | 0.24 | 0.98 | 0.16 |
| Ex. 20 | 1.21 | 0.15 | 1.20 | 0.13 | 1.31 | 0.15 | 1.20 | 0.19 |
| Ex. 21 | 0.95 | 0.12 | 0.65 | 0.15 | 0.83 | 0.21 | 0.89 | 0.13 |
| Ex. 22 | 1.20 | 0.20 | 1.15 | 0.15 | 1.15 | 0.21 | 1.10 | 0.22 |
| Ex. 23 | 0.97 | 0.09 | 0.97 | 0.09 | 1.00 | 0.12 | 0.98 | 0.12 |
| Ex. 24 | 1.00 | 0.08 | 0.95 | 0.08 | 1.01 | 0.15 | 1.00 | 0.12 |
| Ex. 25 | 0.95 | 0.08 | 0.85 | 0.08 | 0.83 | 0.13 | 0.89 | 0.13 |
| Ex. 26 | 0.99 | 0.09 | 0.85 | 0.08 | 0.95 | 0.12 | 0.92 | 0.12 |
| Ex. 27 | 1.00 | 0.11 | 0.97 | 0.13 | 0.95 | 0.14 | 0.98 | 0.15 |
| Ex. 28 | 1.06 | 0.15 | 1.00 | 0.10 | 1.01 | 0.15 | 1.03 | 0.19 |
| Ex. 29 | 0.95 | 0.12 | 0.85 | 0.10 | 0.93 | 0.15 | 0.89 | 0.13 |
| Ex. 30 | 1.03 | 0.16 | 0.95 | 0.11 | 0.99 | 0.13 | 1.00 | 0.15 |
| Ex. 31 | 1.00 | 0.11 | 0.97 | 0.12 | 0.98 | 0.13 | 0.58 | 0.16 |
| Ex. 32 | 1.01 | 0.15 | 1.00 | 0.11 | 1.01 | 0.15 | 0.95 | 0.13 |
| Ex. 33 | 1.33 | 0.08 | 1.10 | 0.08 | 1.20 | 0.18 | 1.10 | 0.13 |
| Ex. 34 | 1.29 | 0.08 | 1.15 | 0.08 | 1.15 | 0.19 | 1.11 | 0.19 |
| Ex. 35 | 1.32 | 0.08 | 1.06 | 0.08 | 1.20 | 0.12 | 1.10 | 0.13 |
| Ex. 36 | 1.34 | 0.08 | 1.15 | 0.08 | 1.15 | 0.12 | 1.10 | 0.19 |
| Comp. Ex. 1 | 1.41 | 0.12 | 1.09 | 0.09 | 0.24 | 0.12 | 0.20 | 0.15 |
| Comp. Ex. 2 | 1.31 | 0.13 | 0.78 | 0.12 | 0.64 | 0.16 | 0.44 | 0.20 |
| Comp. Ex. 3 | 1.35 | 0.12 | 0.65 | 0.11 | 0.31 | 0.15 | 0.35 | 0.19 |

COMPARATIVE EXAMPLES 4 TO 6

The procedure for preparation of the thermosensitive recording material No. 1 according to the present invention in Example 1 was repeated except that the compound (i), the compound (ii) and the compound (iii) respectively used in the Liquids A, B and C in Example 1 were changed as shown in Table 3.

Thus, comparative thermosensitive recording materials No. 4 to No. 6 were fabricated.

Using each of the thermosensitive recording materials Nos. 1, 27 and 28 according to the present invention, and comparative thermosensitive recording materials Nos. 4, 5 and 6, the light-resistance test was carried out in such a fashion that each recording material was exposed to fluorescent lighting of 5000 lux for 100 hours. After the exposure to the fluorescent lighting, the yellow discoloration of the background of the recording material was visually inspected.

The results are shown in Table 3.

TABLE 3

| Example No. | Compound (i) | Compound (ii) | Compound (iii) | Yellow Discoloration (*) |
|---|---|---|---|---|
| Ex. 1 | 1-methyl-2-phenylindole | p-diphenylaminobenzaldehyde | 2,4-dinitrobenzoic acid | ○ |
| Ex. 27 | 1-methyl-2-phenylindole | p-dimethylaminobenzaldehyde | 1,4-cyclohexylidene-bis(m-nitrobenzenesulfonate) | ◎ |
| Ex. 28 | 1-methyl-2-phenylindole | p-diphenylaminobenzaldehyde | 2-methylcyclohexyl-m-nitrobenzenesulfonate | ○ |
| Comp. Ex. 4 | 2-phenylindole | p-dimethylaminobenzaldehyde | 2,4-dinitrobenzoic acid | Δ |
| Comp. Ex. 5 | 2-methylindole | p-dimethylaminobenzaldehyde | 2,4-dinitrobenzoic acid | x |
| Comp. Ex. 6 | 3-methylindole | p-dimethylaminobenzaldehyde | 2,4-dinitrobenzoic | x |

TABLE 3-continued

| Example No. | Compound (i) | Compound (ii) | Compound (iii) | Yellow Discoloration (*) |
|---|---|---|---|---|
| | | | acid | |

(*) The yellow discoloration was relatively assessed in accordance with the following four ranks:
◎: Yellow discoloration hardly took place.
○: Yellow discoloration was little.
Δ: Yellow discoloration was striking.
x: Yellow discoloration was remarkably striking.

As can be seen from the results in Table 2, even though the cottonseed oil and the DOA are applied to the colored portion, the decrease of image density of the colored portion is remarkably smaller in the thermosensitive recording materials according to the present invention as compared with that in the comparative thermosensitive recording materials.

The water resistance of the colored portion in the thermosensitive recording materials of the present invention is superior to that in the comparative thermosensitive recording materials.

The reliability of the colored portion is regarded as conspicuously increased in the thermosensitive recording materials according to the present invention.

Furthermore, it is confirmed that the reliability of the colored portion is further improved by the addition of the quinone compound when comparing the recording materials Nos. 19 and 20 with the recording material No. 1 according to the present invention, or comparing the recording materials Nos. 21 and 22 with the recording material No. 4 according to the present invention.

In addition, it is confirmed that the coloring thermosensitivity of the recording material is further improved by the addition of the thermofusible material when comparing the recording materials Nos. 33 to 36 with the recording material No. 1 according to the present invention.

As is apparent from the results in Table 3, the thermosensitive recording materials according to the present invention are superior to the comparative recording materials with respect to the yellow discoloration of the background thereof in the light-resistance test. This is because the indole compound for use in the thermosensitive recording material of the present invention has a substituent except hydrogen atom at the 1-position, that is, at the position of nitrogen.

As previously explained, since the thermosensitive recording material comprises (i) the N-substituted indole or aromatic polyhydroxy compound, (ii) the carbonyl compound, and (iii) the acid material, the recording material is capable of producing images therein with high water resistance, oil resistance, and plasticizer resistance. The preservability of the recording material is also improved from the viewpoints of moisture resistance, light resistance and heat resistance.

With the addition of (iv) the quinone compound, the above-mentioned reliability of the obtained images can further be improved.

Furthermore, the coloring thermosensitivity of the thermosensitive recording material of the present invention is further improved when (v) the thermofusible material is contained in the thermosensitive recording layer.

Japanese Patent Application No. 05-128100 filed on Apr. 30, 1993, Japanese Patent Application No. 05-242069 filed on Sep. 2, 1993, Japanese Patent Application No. 05-302414 on Nov. 8, 1993, and Japanese Patent Application filed on Apr. 8, 1994 are hereby incorporated by reference.

What is claimed is:

1. A thermosensitive recording material capable of being imagewise colored when heated comprising: a support, and a thermosensitive recording layer formed thereon which comprises:

(i) an N-substituted indole or an aromatic polyhydroxy compound, (ii) a carbonyl compound, and (iii) an acid material other than (i).

2. The thermosensitive recording material as claimed in claim 1, wherein said N-substituted indole is a compound of formula (1):

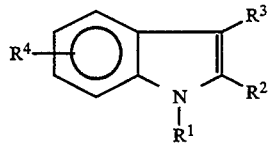

(1)

wherein $R^1$ is a halogen atom, an alkyl group having 1 to 5 carbon atoms which may have a substituent, an aryl group which may have a substituent, or an aralkyl group which may have a substituent; and $R^2$, $R^3$, $R^4$ each is hydrogen, a halogen atom, an alkyl group having 1 to 5 carbon atoms which may have a substituent, an aryl group which may have a substituent, or an aralkyl group which may have a substituent.

3. The thermosensitive recording material as claimed in claim 1, wherein said carbonyl compound is a substituted or unsubstituted aromatic aldehyde compound.

4. The thermosensitive recording material as claimed in claim 1, wherein said carbonyl compound is a heterocyclic aldehyde compound.

5. The thermosensitive recording material as claimed in claim 1, wherein said acid material comprises at least one component selected from the group consisting of an organic carboxylic acid, an organic sulfonic acid, and a metallic chloride.

6. The thermosensitive recording material as claimed in claim 1, wherein said acid material is a compound which can be thermally decomposed to become acidic when heated.

7. The thermosensitive recording material as claimed in claim 6, wherein said acid material is a sulfonic acid ester having a thermal decomposition temperature of 60° C. or more.

8. The thermosensitive recording material as claimed in claim 1, wherein said thermosensitive recording layer further comprises a quinone compound.

9. The thermosensitive recording material as claimed in claim 8, wherein said quinone compound is of the formulae:

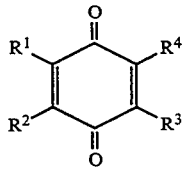

(3)

or

-continued (4)

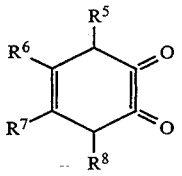

wherein $R^1$ to $R^8$ each is a halogen atom, cyano group, nitro group, carboxyl group, alkoxycarbonyl group, aryloxycarbonyl group, aralkyloxycarbonyl group, alkylsulfonyl group, or an arylsulfonyl group.

10. The thermosensitive recording material as claimed in claim 1, wherein said thermosensitive recording layer further comprises a thermofusible material.

11. The thermosensitive recording material as claimed in claim 10, wherein said thermofusible material is a phenolic compound.

12. The thermosensitive recording material as claimed in claim 1, further comprises an intermediate layer which is provided between said support and said thermosensitive recording layer.

13. The thermosensitive recording material as claimed in claim 1, wherein (i) is an N-substituted indole.

14. The thermosensitive recording material as claimed in claim 1, wherein (i)is an aromatic polyhydroxy compound.

* * * * *